United States Patent [19]

Smith, Jr.

[11] 4,153,159

[45] May 8, 1979

[54] TELLTALE DAMAGE INDICATOR FOR SHIPPING CARTONS

[75] Inventor: J. Lindley Smith, Jr., Lake Bluff, Ill.

[73] Assignee: Outboard Marine Corporation, Waukegan, Ill.

[21] Appl. No.: 833,504

[22] Filed: Sep. 15, 1977

[51] Int. Cl.[2] ..... B65D 85/68

[52] U.S. Cl. ..... 206/319; 206/583; 248/640

[58] Field of Search ..... 206/319, 454, 459, 804, 206/806, 583; 248/4, 17; 217/66, 67, 68

[56] References Cited

U.S. PATENT DOCUMENTS

| | | | |
|---|---|---|---|
| 1,981,724 | 11/1934 | Donovan, Jr. | 206/45.16 |
| 1,991,427 | 2/1935 | Spachmann et al. | 206/45.16 |
| 2,112,551 | 3/1938 | Anderson | 206/45.16 |
| 2,281,251 | 4/1942 | Simmons | 206/804 |
| 2,302,784 | 11/1942 | Lytton et al. | 206/248 |
| 2,303,426 | 12/1942 | Biggs | 206/248 |
| 2,843,258 | 7/1958 | Boeye | 206/319 |
| 3,439,827 | 4/1969 | Marland | 206/804 |

*Primary Examiner*—Herbert F. Ross

*Attorney, Agent, or Firm*—Michael, Best & Friedrich

[57] ABSTRACT

Disclosed herein is a shipping carton including an internal support structure having a support member for supporting an article, such as an outboard marine motor, in a suspended shipping position and external telltale damage indicating means for indicating movement of the article relative to the carton from the shipping position. The indicating means includes a flexible element having one end connected to the article or to the support member and a free end including a slidably mounted position-indicating portion which, when the article is in the shipping position, extends a predetermined distance exteriorly of the carton and which, in response to movement of the article from the shipping position, is pulled inwardly towards the interior of the carton to thereby indicate the amount of movement of the article from the shipping position.

12 Claims, 3 Drawing Figures

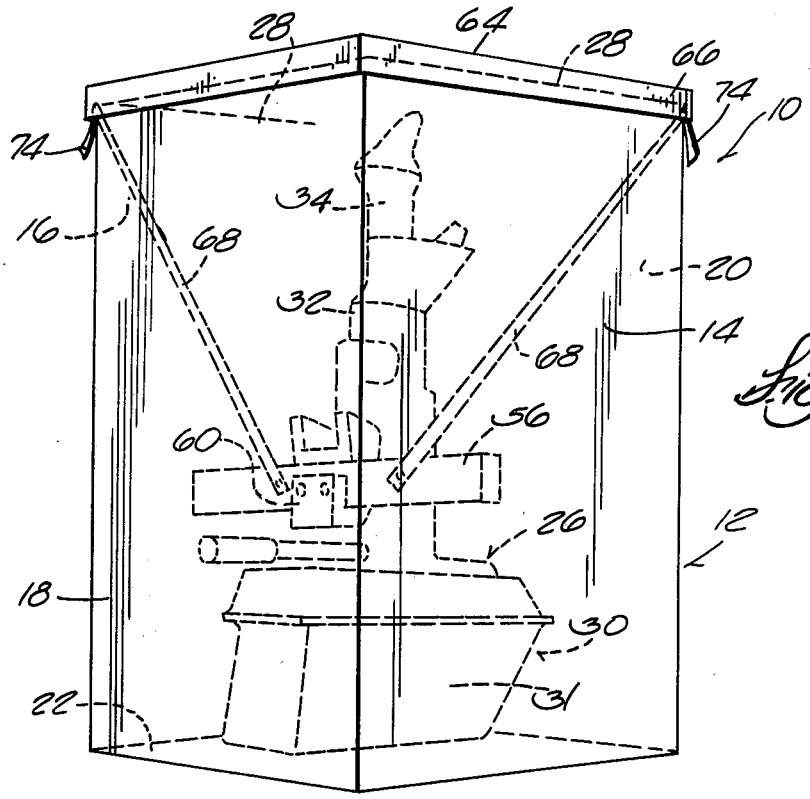
Fig. 1
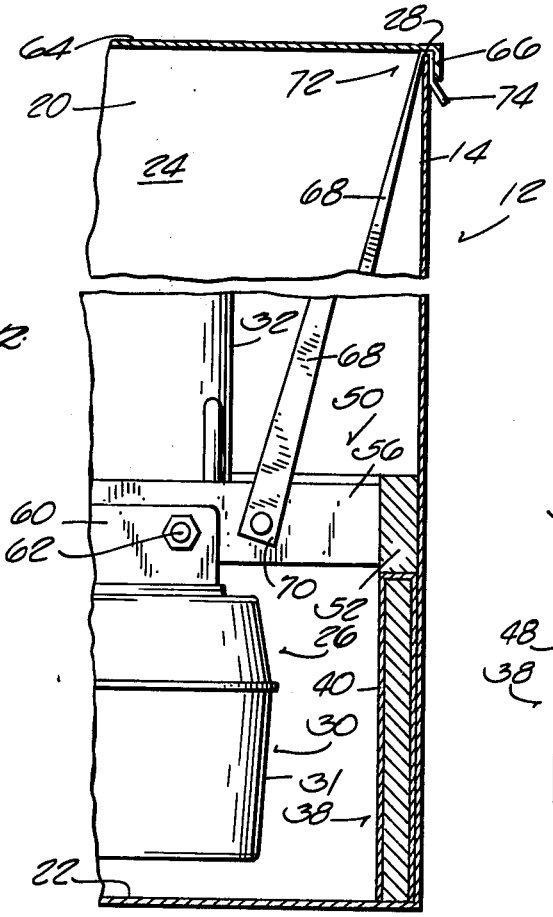
Fig. 2
Fig. 3
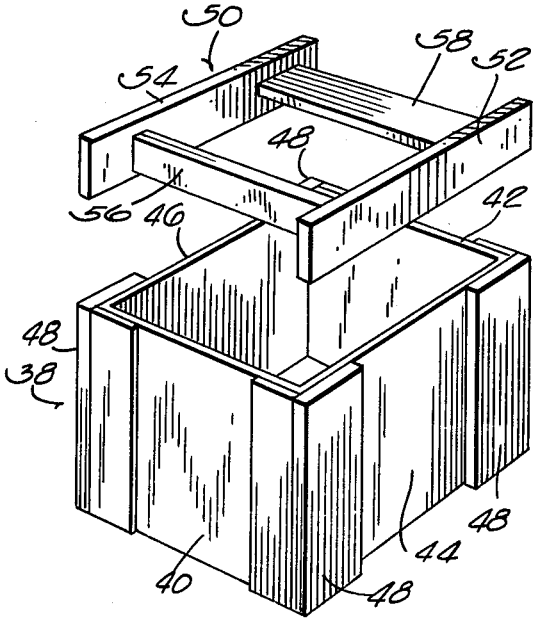

TELLTALE DAMAGE INDICATOR FOR SHIPPING CARTONS

BACKGROUND OF THE INVENTION

This invention relates to shipping cartons and, more particularly, to telltale damage indicators for shipping cartons adapted to support an article in a suspended shipping position.

In one type of shipping carton, the article contained therein, such as an outboard marine motor, is supported in a suspended shipping position by an internal support structure. The support structure is subject to damage or failure from such rough handling of the shipping carton as may cause the article to drop down inside the carton and thus become damaged. This condition can exist even though there is no external evidence of damage to the shipping carton, in which case damage to the article is not observed until the shipping carton is opened. Consequently, damage may not be observed until after the article has reached its final destination. At that point, it is often impossible to accurately determine who is responsible for the damage, particularly when the shipping carton is handled by several different parties along the route from the manufacturer to its final destination.

It is desirable to provide means for externally indicating possible damage to the article so that the receiving party is warned to inspect for damage prior to acceptance of the article.

SUMMARY OF THE INVENTION

The invention provides a shipping carton including side walls and an end wall defining an interior compartment for receiving an article, a support member adapted to support the article in a shipping position spaced from at least one of the walls, and telltale damage indicating means connected to the article or to the support member and movable therewith for indicating movement of the article relative to the carton from the shipping position. The indicating means includes a visible position-indicating portion which, when the article is in the shipping position, extends a predetermined distance exteriorly of the carton in slidable relationship thereto and which, in response to movement of the article from the shipping position, is pulled inwardly toward the compartment to thereby indicate the amount of movement of the article from the shipping position.

In one embodiment, the side walls have an upper edge, the carton includes a cover adapted to fit over these upper edges and close the compartment, and a part of the indicating means slidably extends between the cover and one of the upper edges and includes the position-indicating portion.

In one embodiment, the indicating means includes a flexible, elongated element having one end connected to the article or the support member and having a free end which is draped over an upper edge of a side wall, which is slidably disposed between that edge and a cover fitting over the side wall edges to close the compartment, and which includes the position-indicating portion.

In one embodiment, the position-indicating portion of the indicating means extends exteriorly of the carton at a distance corresponding to a predetermined amount of movement of the article from the shipping position which could cause damage to the article such that, in the event the article moves from a shipping position the predetermined amount, the position-indicating portion is no longer visible from the exterior of the carton, thereby indicating potential damage to the article.

In one embodiment, the carton is adapted for shipping an outboard marine motor and includes opposed vertical side walls and a bottom wall defining a compartment for receiving the motor, a support member disposed inside the compartment and adapted to support the motor in a generally vertical shipping position with a portion thereof located in spaced relationship to the bottom wall, and the indicating means is connected to the motor or the support member. The position-indicating portion of the indicating means preferably extends exteriorly of the carton at a distance generally equal to or less than the distance between the motor portion and the bottom wall such that, in the event the motor portion drops down onto the bottom wall, the position-indicating portion is no longer visible from the exterior of the carton.

One of the principal features of the invention is the provision of a shipping carton including means for externally indicating possible damage to the article carried inside the carton without opening the carton.

Another of the principal features of the invention is the provision of a telltale damage indicator for shipping cartons including means which is visible from the exterior of the carton and is operable for indicating the amount of movement of an article carried inside the carton from a shipping position.

A further of the principal features of the invention is the provision of a damage indicator of the type described in the previous paragraph and which is particularly adaptable for shipping cartons carrying outboard marine motors and does not require external holes in the shipping carton.

Other features and advantages of the embodiments of the invention will become apparent to those skilled in the art upon reviewing the following detailed description, the drawing and the appended claims.

BRIEF DESCRIPTION OF THE DRAWING

FIG. 1 is a perspective view of a shipping carton for an outboard marine motor incorporating a telltale damage indicator embodying various of the features of the invention.

FIG. 2 is an enlarged, fragmentary sectional view of the shipping carton of FIG. 1.

FIG. 3 is an exploded, perspective view of the support structure located inside the shipping carton of FIG. 1 for supporting the outboard marine motor in an inverted, suspended shipping position illustrated by dashed lines in FIG. 1.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENTS

Illustrated in the drawing is a conventional shipping carton 10 including an outer container 12 made from corrugated or solid paperboard and having a first pair of opposed side walls 14 and 16, and a second pair of opposed side walls 18 and 20, and an end or bottom wall 22 which cooperates with the side walls to define an interior compartment 24 for receiving an outboard marine motor 26. Each of the side walls 14, 16, 18 and 20 has a normally open upper edge 28 and all the walls, including the bottom wall 22, preferably are imperforate.

The outboard marine motor 26 has an upper unit or powerhead 30 including a housing or cowl 31 housing a motor (not shown), a drive shaft housing 32 depending from the powerhead 30, and a lower unit 34 connected to the lower end of the drive shaft housing 32.

Disposed inside the compartment 24 and resting on the bottom wall 22 (see FIG. 3) is a liner assembly 38 made from a corrugated or solid paperboard and including a first pair of opposed side panels 40 and 42, a second pair of opposed side panels 44 and 46, and auxiliary stiffening or reinforcing corner members or posts 48.

Supported on top the liner assembly 38 and adapted to support the motor 26 inside the compartment 24, such as in a generally vertical, inverted shipping position with the powerhead 30 spaced from the bottom wall 22 (as shown in FIG. 3), is a support frame 50 including side members 52 and 54 which are formed from a paperboard and rest primarily on the top edges of the corner posts 48. Extending between the side members 52 and 54 and suitably fastened thereto is a support member or beam 56, made from wood or other suitable material, and a cross member 58, made from paperboard or other suitable material. In FIG. 1 the liner assembly 38 and the support structure 50, except the support beam 56, have been omitted for purposes of clarity.

The motor 26 is suitably secured to the support beam 56. In the specific construction illustrated, the motor 26 is a larger type and includes a transom bracket 60 which is fastened on the support beam 56 with bolts 62. Smaller outboard motors having one or more transom clamps can be secured to the support beam 56 by tightening the transom clamp(s) thereon.

The shipping carton 10 also includes an imperforate top or cover 64, including a downturned peripheral portion 66 which fits over the upper edges 28 of the side walls 14, 16, 18 and 20 in a conventional manner to close the compartment 24. As thus far described, the construction is conventional.

In the event the support structure 50 or the liner assembly 38 is damaged or fails during handling or shipment and the motor 26 is permitted to drop down onto the bottom wall 22, the powerhead housing 31 and/or other components of the motor 26 can be damaged even though the exterior of the shipping carton 10 has no evidence of damage.

Telltale damage indicator means are provided for externally indicating the amount of movement of the motor 26 relative to the shipping carton 10 from the shipping position. More specifically, such damage indicator means is connected to the motor 26 or the support structure 50, is movable therewith, and includes a visible position-indicating portion which, when the motor 26 is in the shipping position, extends a predetermined distance exteriorly of the shipping carton 10 in slidable relationship thereto and which, in response to movement of the motor 26 from the shipping position, is pulled inwardly toward the compartment 24. While various arrangements can be used, in the specific construction illustrated, such means includes a pair of oppositely extending, flexible, position-indicating elements 68, such as a strip of cloth, each having one end 70 connected to the support beam 56 as shown or to the motor 26 (e.g., to the drive shaft housing 32) and a free end portion 72 which is draped over a side wall edge 28 and slidably extends between the cover 64 and the container 12.

In the specific construction illustrated, the upper edges 28 of the container side walls have a downturned lip (not shown) which receives an unturned lip (not shown) on the cover 64 to interlock the cover 64 on the container 12. Consequently, the indicating elements 68 extend over the corners where the interlock does not exist as shown in FIG. 1.

The outermost portion 74 of the free end 72 of each position-indicating element 68 is visually observable from the exterior of the carton 10 when the motor 26 is in the proper shipping position. If the motor 26 moves relative to the carton 10 because of damage to or failure of the support structure 50 or the liner assembly 38, one or both of the position-indicating elements 68 are pulled inwardly toward the compartment 24. The resultant decrease in the length of the visible portion 74 of the position-indicating element 68 is indicative of the amount of such movement.

Preferably, the visible portions 74 of the position-indicating elements 68 extend exteriorly of the carton 10 at a predetermined distance generally equal to or less than the distance between the powerhead 30 and the bottom wall 22 so that, in the event the motor 26 drops down onto the bottom wall 22, the entire visible portions 74 of the position-indicating elements 68 are pulled into the compartment 24 and are no longer visible from the exterior of the carton 10. On the other hand, some settling of the support structure 50 can occur without the visible portions 74 of the position-indicating elements 68 disappearing. With this preferred arrangement, a receiving party can quickly check the exterior of the carton 10 to determine whether one or more of the visible portions 74 of the position-indicating elements 68 is visible and, if it is not, the carton 10 can be opened to inspect for damage prior to acceptance.

The telltale damage indicating means of the invention is particularly advantageous for use with the illustrated type of conventional shipping carton because external holes in the carton are not required and such external holes are prohibited for international transit. However, it should be understood that the invention also can be used for any other types of shipping cartons, so long as a portion of the position-indicating means is located exteriorly of the carton in slidable relationship thereto. Also, it should be understood that the invention can be used in conjunction with a variety of different articles, other than outboard marine motors, which are mounted inside a shipping carton in a manner whereby a shift in position relative to the carton could result in damage.

Various of the features of the invention are set forth in the following claims:

What is claimed is:

1. A closable shipping carton for an article comprising side walls and an end wall defining an interior compartment for receiving the article, a support member disposed inside said carton and adapted to support the article in a shipping position spaced from at least one of said walls, and non-supporting telltale damage indicating means connected to the article or to said support member and movable therewith for indicating movement of the article relative to said carton from the shipping position, said indicating means including a visible position-indicating portion which, when the article is in the shipping position, extends a predetermined distance exteriorly of said carton in slidable relationship thereto and which, in response to movement of the article from the shipping position after said carton is closed, is pulled inwardly toward said compartment to thereby indicate the amount of movement of the article from the shipping position.

2. A shipping carton according to claim 1 wherein said position-indicating portion of said indicating means extends exteriorly of said carton at a distance generally corresponding to a predetermined amount of movement of the article from the shipping position which could cause damage to the article such that, in the event the article moves from the shipping position said predetermined amount, said position-indicating portion is no longer visible from the exterior of said carton, thereby indicating potential damage to the article.

3. A shipping carton according to claim 1 wherein said side walls have an upper edge, said carton includes a cover adapted to fit over said side wall upper edges and close said compartment, and a part of said indicating means slidably extends between said cover and one of said upper edges and includes said position-indicating portion.

4. A shipping carton according to claim 3 wherein said indicating means includes a flexible, elongated element having one end connected to the article or to said support member and wherein said part comprises a free end which is draped over a said side wall upper edge and is slidably disposed between said edge and said cover and which includes said position-indicating portion.

5. A shipping carton according to claim 4 wherein said side walls are generally vertical and said end wall is a bottom wall, said support member supports the article in spaced relationship to said bottom wall, and said position-indicating portion of said element extends exteriorly of said carton at a distance generally equal to or less than the distance between the article and said bottom wall such that, in the event the article drops down onto said bottom wall, said position-indicating portion is no longer visible from the exterior of said carton.

6. A shipping carton according to claim 5 including a pair of said elements, said free end of each being draped over one of said upper edges.

7. A shipping carton according to claim 5 wherein said walls are imperforate.

8. A shipping carton for an outboard marine motor, said carton comprising opposed vertical side walls and a bottom wall defining a compartment for receiving the motor, a support member disposed inside said compartment and adapted to support the motor in a generally vertical shipping position with a portion thereof located in spaced relationship to said bottom wall, and a telltale damage indicating means connected to the motor or said support member and movable therewith for indicating movement of the motor from the shipping position toward said bottom wall, said indicating means including a visible position-indicating portion which, when the motor is in the shipping position, extends a predetermined distance exteriorly of said carton in slidable relationship thereto and which, in response to movement of the motor from the shipping position toward said bottom wall, is pulled inwardly toward said compartment to thereby indicate the amount of movement of the motor from the shipping position toward said bottom wall.

9. A shipping carton according to claim 8 wherein said side walls have an upper edge, said carton includes a cover adapted to fit over said upper edges and close said compartment, and said indicating means comprises a flexible, elongated element having one end connected to the motor or to the support member and a free end which is draped over a said side wall upper edge, which is slidably disposed between said upper edge and said cover, and which includes said position-indicating portion.

10. A shipping carton according to claim 9 wherein said position-indicating portion of said element extends exteriorly of said carton at a distance generally equal to or less than the distance between said motor portion and said bottom wall such that, in the event said motor portion drops down onto the said bottom wall, said position-indicating portion is no longer visible from the exterior of said carton.

11. A shipping carton according to claim 10 including a pair of said elements, said free end of each being draped over one of said upper edges.

12. A shipping carton according to claim 8 wherein said walls are imperforate.

* * * * *